US011814279B1

(12) United States Patent
Nuttall

(10) Patent No.: US 11,814,279 B1
(45) Date of Patent: Nov. 14, 2023

(54) WATER DISPENSING LINE RECIRCULATION

(71) Applicant: Quench USA, Inc., King Of Prussia, PA (US)

(72) Inventor: Andrew Troy Nuttall, Queen Creek, AZ (US)

(73) Assignee: QUENCH USA, INC., King Of Prussia, PA (US)

( * ) Notice: Subject to any disclaimer, the term of this patent is extended or adjusted under 35 U.S.C. 154(b) by 0 days.

(21) Appl. No.: 18/143,227

(22) Filed: May 4, 2023

Related U.S. Application Data

(60) Provisional application No. 63/351,001, filed on Jun. 10, 2022.

(51) Int. Cl.
*B67D 1/00* (2006.01)
*B67D 1/10* (2006.01)

(52) U.S. Cl.
CPC ..... *B67D 1/0081* (2013.01); *B67D 1/0004* (2013.01); *B67D 1/10* (2013.01); *B67D 2001/0093* (2013.01)

(58) Field of Classification Search
CPC ..... B67D 1/0081; B67D 1/0004; B67D 1/10; B67D 2001/0093
See application file for complete search history.

(56) References Cited

U.S. PATENT DOCUMENTS 2,750,076 A * 6/1956 Welty ..... B67D 1/0021 222/146.6
6,324,850 B1 12/2001 Davis
9,243,387 B2 * 1/2016 Forte ..... B67D 1/07
9,480,762 B2 11/2016 Wang et al.
9,750,835 B2 9/2017 Wang et al.
2002/0189276 A1 12/2002 Davis
(Continued)

FOREIGN PATENT DOCUMENTS

DE 202011000505 U1 10/2011
JP H8238178 A 9/1996
WO 2021198144 A1 10/2021

OTHER PUBLICATIONS

International Search Report and Written Opinion dated Jul. 27, 2023 in International Application No. PCT/US2023/21099.

*Primary Examiner* — Donnell A Long
(74) *Attorney, Agent, or Firm* — Panitch Schwarze Belisario & Nadel LLP

(57) ABSTRACT

A water-dispensing device includes a water tank, a dispensing line, a pump configured to draw water from the tank into the dispensing line, an outlet line, a dispensing valve, a spigot downstream of the outlet line and in selective fluid communication therewith via the dispensing valve, and a valveless directional fitting that couples the dispensing line to the outlet line for enabling fluid communication therebetween. The fitting has a hollow main body extending between an inlet port and a dispensing port. The dispensing line is connected to the inlet port and the outlet line is connected to the dispensing port. The fitting has a recirculation port that intersects an interior of the main body. The recirculation port has a smaller diameter than the dispensing port. A recirculation line is connected to the recirculation port and the water tank to place the water tank in fluid communication with the recirculation port.

18 Claims, 5 Drawing Sheets

(56) References Cited

U.S. PATENT DOCUMENTS

| | | | | |
|---|---|---|---|---|
| 2004/0216615 | A1* | 11/2004 | Rava | B67D 1/0004 99/275 |
| 2008/0087036 | A1 | 4/2008 | Tavolazzi et al. | |
| 2010/0252570 | A1* | 10/2010 | Yui | B67D 1/0801 222/173 |
| 2010/0266742 | A1* | 10/2010 | Ferreira | B67D 1/0888 426/477 |
| 2010/0276451 | A1* | 11/2010 | Tachibana | B67D 1/04 222/190 |
| 2011/0084096 | A1 | 4/2011 | Schroeder | |
| 2011/0120921 | A1* | 5/2011 | Kim | B67D 1/0895 210/138 |
| 2013/0272923 | A1 | 10/2013 | Wang et al. | |
| 2015/0083250 | A1* | 3/2015 | Orita | B67D 3/0038 137/565.17 |
| 2015/0128615 | A1 | 5/2015 | Hu et al. | |
| 2015/0217984 | A1* | 8/2015 | Orita | B67D 1/0892 222/95 |
| 2016/0023880 | A1* | 1/2016 | Forte | B67D 1/10 134/22.18 |
| 2016/0029823 | A1* | 2/2016 | Tuggle | B67D 1/0004 222/146.6 |
| 2016/0046508 | A1* | 2/2016 | Orita | B67D 1/07 222/146.1 |
| 2022/0063980 | A1* | 3/2022 | Rudick | B67D 1/1247 |

* cited by examiner

WATER DISPENSING LINE RECIRCULATION

CROSS-REFERENCE TO RELATED APPLICATIONS

This application claims the benefit of U.S. Provisional Patent Application No. 63/351,001, filed on Jun. 10, 2022, entitled, "Water Dispensing Line Recirculation,", the entire contents of which are incorporated by reference herein.

BACKGROUND

Embodiments described herein relate generally to water dispensers, and more particularly, to a water dispenser that enables recirculation of water held in the dispensing line.

Water dispensers often include an insulated tank that maintains water at a cold temperature (e.g., typically less than 50° F.). The tank may also include equipment for chilling the water to the desired temperature. However, conventional water dispensers include a dispensing line (typically a tubing made from silicone or the like) that puts a dispensing valve in fluid communication with the cold water tank. The dispensing line is usually located external to the tank and can be relatively long, particularly in water dispensers with larger tanks that require a dispensing pump to move the water to the dispensing valve. Water sitting in the dispensing line between dispensing operations can warm over time. In the next dispensing operation, this warmed water is output, making for a potentially unpleasant experience for the user. Moreover, as the water held in the dispensing line stagnates, the opportunity for bacterial growth increases.

It is desirable to provide a water dispenser that is capable of enabling water in the dispensing line to recirculate back to the cold water tank, in order to maintain colder water in the dispensing line and to mitigate against bacterial growth from stagnation, while being simple and inexpensive to implement.

BRIEF SUMMARY

Briefly stated, one embodiment comprises a water-dispensing device including a water tank, a dispensing line in fluid communication with the water tank, a pump configured to draw water from the water tank into the dispensing line, an outlet line, a dispensing valve, a spigot downstream of the outlet line and in selective fluid communication therewith via the dispensing valve, and a valveless directional fitting that couples the dispensing line to the outlet line for enabling fluid communication therebetween. The fitting has a hollow main body extending between an inlet port and a dispensing port. The dispensing line is connected to the inlet port and the outlet line is connected to the dispensing port. The fitting has a recirculation port that intersects an interior of the hollow main body. The recirculation port has a diameter that is smaller than a diameter of the dispensing port. A recirculation line is connected at one end to the recirculation port of the fitting and at an opposing end to the water tank to place the water tank in fluid communication with the recirculation port.

In one aspect, the device further includes a controller in wired or wireless communication with the pump. In another aspect, the controller is configured to perform a recirculation operation by, with the dispensing valve in a closed position, activating the pump. In yet another aspect, the controller is configured to perform the recirculation operation upon determining that a designated time for automatic recirculation has been reached. In still another aspect, the designated time is a preset period of inactivity of the pump. In a further aspect, the controller is configured to deactivate the pump after a maximum recirculation time has been reached. In a still further aspect, the maximum recirculation time is based on a predetermined time required to displace stagnant water residing in the dispensing line and the recirculation line.

In another aspect, the recirculation line connects to a top of the water tank. In still another aspect, an air gap is maintained between the top of the water tank and a level of water in the water tank.

In yet another aspect, the main body of the fitting has an elbow bend between the inlet port and the dispensing port.

In still another aspect, a diameter of inlet port is substantially equal to the diameter of the dispensing port.

In a further aspect, the recirculation port extends generally perpendicularly away from the hollow main body of the fitting.

In a still further aspect, a location of the recirculation port is offset on the hollow main body of the fitting relative to a location of the dispensing port.

Another embodiment comprises a method for performing an automatic recirculation operation in a water dispenser having a water tank, a controller, a dispensing line, a pump, an outlet line, a dispensing valve, a spigot downstream of the outlet line and in selective fluid communication therewith via the dispensing valve, a recirculation line, and a valveless directional fitting that couples the dispensing line to the outlet line for enabling fluid communication therebetween. The fitting has a hollow main body extending between an inlet port and a dispensing port. The dispensing line is connected to the inlet port and the outlet line is connected to the dispensing port. The fitting has a recirculation port that intersects an interior of the hollow main body. The recirculation port has a diameter that is smaller than a diameter of the dispensing port. The recirculation line is connected between the recirculation port and the water tank to place the water tank in fluid communication with the recirculation port. The method includes determining, by the controller, whether a designated time for automatic recirculation has been reached, when the designated time has been reached, checking, by the controller, whether the dispensing valve is in a closed position, and with the dispensing valve in the closed position, activating, by the controller, the pump to circulate water from the water tank into the dispensing line, through the hollow main body of the fitting into the recirculation port, through the recirculation line, and back into the water tank.

In one aspect, the method further includes determining, by the controller, if a maximum recirculation time has been reached, and when the maximum recirculation time has been reached, deactivating, by the controller, the pump. In another aspect, the maximum recirculation time is based on a predetermined time required to displace stagnant water residing in the dispensing line and the recirculation line.

In yet another aspect, the method further includes, when the dispensing valve is found by the controller to be in an open position, closing, by the controller, the dispensing valve.

In still another aspect, the designated time is a preset period of inactivity of the pump.

BRIEF DESCRIPTION OF THE SEVERAL VIEWS OF THE DRAWINGS

The following detailed description of preferred embodiments will be better understood when read in conjunction with the appended drawings. For the purpose of illustration, there are shown in the drawings embodiments which are presently preferred. It should be understood, however, that the invention is not limited to the precise arrangements and instrumentalities shown.

In the drawings.

DETAILED DESCRIPTION

Figure 1:
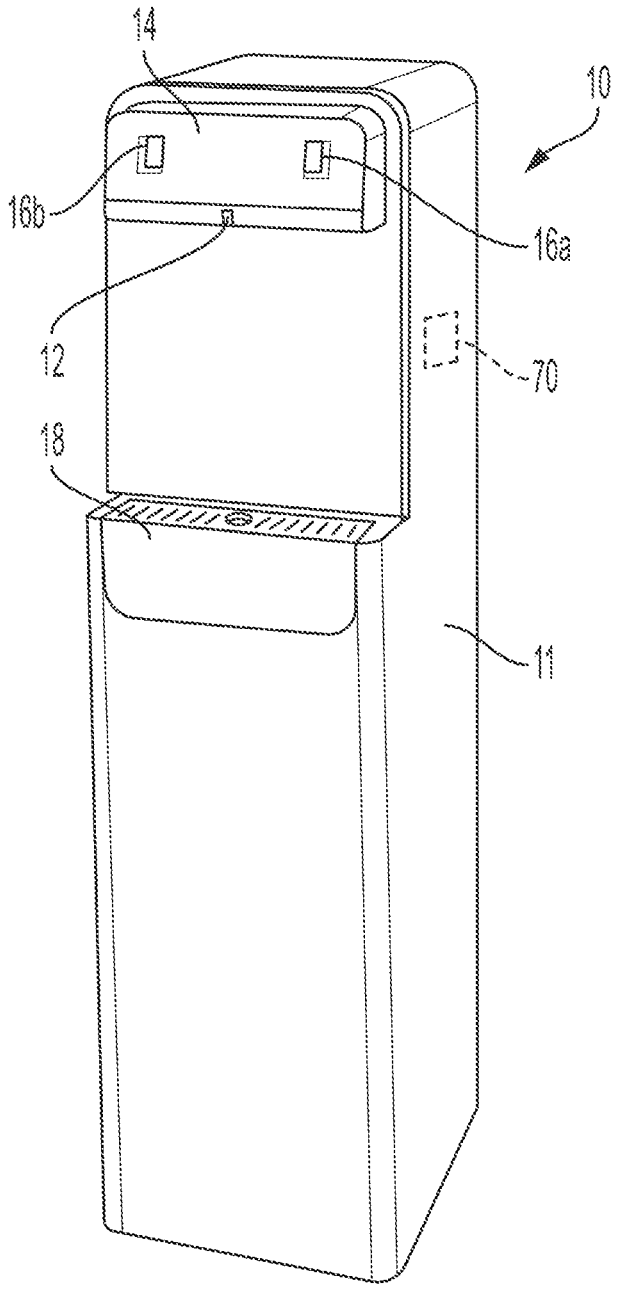
FIG. 1 is a front perspective view of a water-dispensing device in accordance with a first example embodiment of the present invention.

Certain terminology is used in the following description for convenience only and is not limiting. The words "right", "left", "lower", and "upper" designate directions in the drawings to which reference is made. The words "inwardly" and "outwardly" refer to directions toward and away from, respectively, the geometric center of the device and designated parts thereof. The terminology includes the above-listed words, derivatives thereof, and words of similar import. Additionally, the words "a" and "an", as used in the claims and in the corresponding portions of the specification, mean "at least one."

It should also be understood that the terms "about," "approximately," "generally," "substantially" and like terms, used herein when referring to a dimension or characteristic of a component, indicate that the described dimension/characteristic is not a strict boundary or parameter and does not exclude minor variations therefrom that are functionally similar. At a minimum, such references that include a numerical parameter would include variations that, using mathematical and industrial principles accepted in the art (e.g., rounding, measurement or other systematic errors, manufacturing tolerances, etc.), would not vary the least significant digit.

Referring to FIG. 1, there is shown a first example embodiment of a water-dispensing device 10 in accordance with the present invention. FIG. 1 depicts a free-standing water-dispensing device 10, but the water-dispensing device 10 may be of any conventional type in keeping within the spirit and scope of the invention, such as a countertop dispenser, a built-in (e.g., cabinet-mounted) dispenser, or the like. The water-dispensing device 10 may include a housing 11 and may have a spigot 12 mounted in or on the housing 11 for dispensing water into a vessel (not shown), such as a cup, glass, bottle, or the like. The dispensing device 10 may further include an operation panel 14, which can provide one or more dispensing actuators 16*a*, 16*b*, such as buttons, touchscreen icons, or the like. In the embodiment of FIG. 1, the dispensing actuators 16*a*, 16*b* are touch-free sensors for hygienic operation. For example, a user need only bring a finger or hand in proximity to a sensor 16*a*, 16*b* to initiate a water dispensing operation. The first sensor 16*a* triggers cold water dispensing, while the second sensor 16*b* triggers hot water dispensing. A drip tray 18 may be positioned beneath the spigot 12. The drip tray 18 may support the vessel during a water dispensing operation, but is preferably also configured to provide a container to catch water accidentally spilled from the vessel or the spigot 12.

Figure 2:
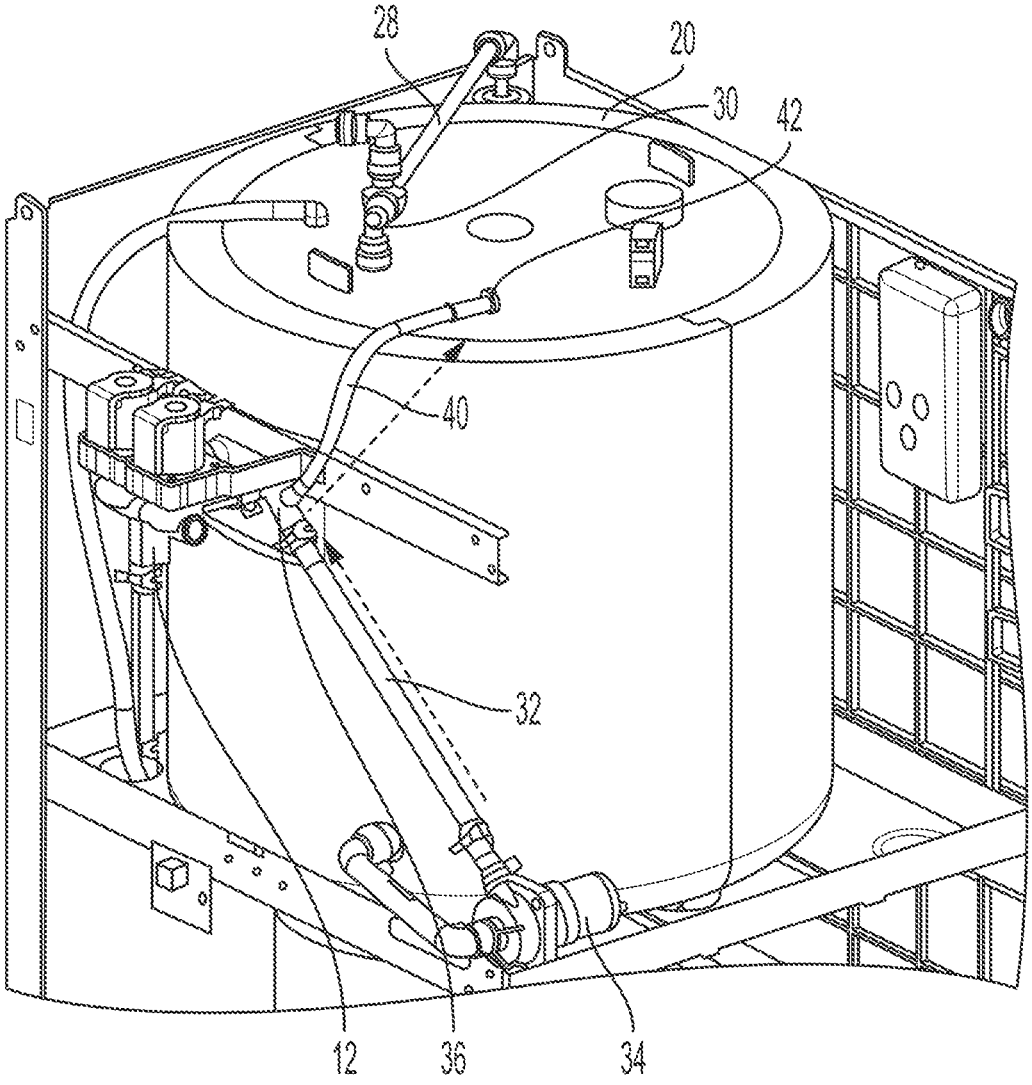
FIG. 2 is a front perspective view of a cold water tank and affiliated plumbing within the water-dispensing device of FIG. 1.
Figure 3:
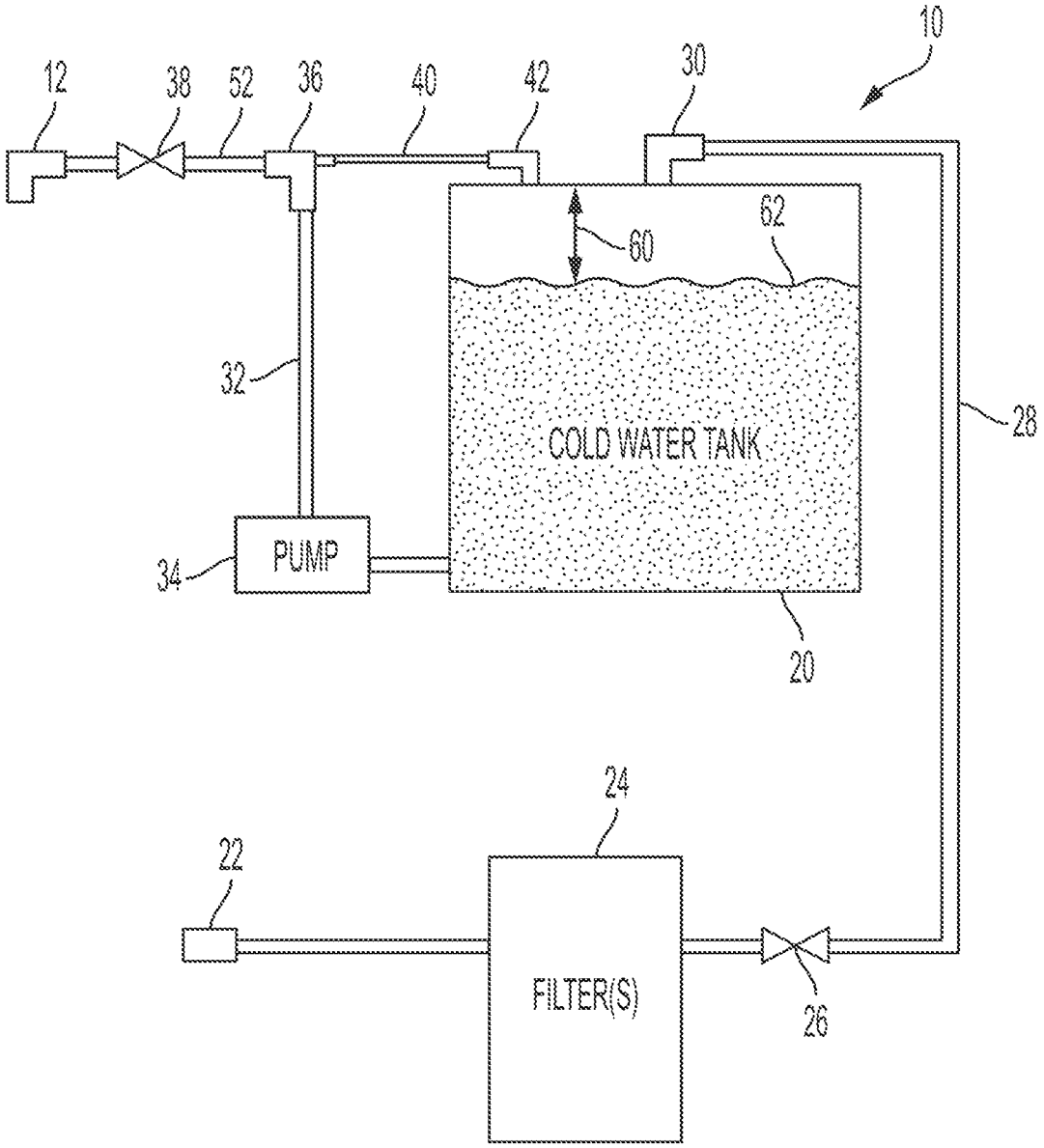
FIG. 3 is a schematic plumbing diagram of a portion of the water-dispensing device of FIG. 1.

Referring to FIGS. 2-3, the water-dispensing device 10 may include a cold water tank 20 disposed within the housing 11 (FIG. 1) and which is preferably configured to store water at a temperature below 50° F. The cold water tank 20 may be insulated and include equipment (not shown) for chilling water contained therein, as is conventionally known. However, chilling equipment (not shown) may be provided separately from the cold water tank 20. The cold water tank 20 shown in FIG. 2 may be capable of storing up to three gallons of cold water, although other volumes may be used as well. The water-dispensing device 10 may additionally or alternatively include a hot water tank (not shown) disposed within the housing 11 and which is preferably configured to store water at a temperature over 160° F. The hot water tank may be insulated and include equipment (not shown) for heating water contained therein, as is conventionally known, although heating equipment may alternatively be provided external to the hot water tank.

The water-dispensing device 10 may include a water intake 22 that may be directly or indirectly connected to a water source (not shown), such as a building water supply, a container, or any other like source of water. One or more filters 24 may be located upstream of the cold water tank 20 in order to filter water before it is conditioned (e.g., cooled) and stored. For example, the filters 24 may be sediment, carbon, reverse osmosis, ultra filtration, and/or other like types of filters. One or more fill valves 26 may be disposed between the filters 24 (and/or the water intake 22) and the cold water tank 20 to control filling operations. The fill valve 26 may be a solenoid valve or other type of electrically-actuated valve. A fill line 28 may be connected between the fill valve 26 and an elbow fitting 30 atop the cold water tank 20, although other types of fittings and connections to the cold water tank 20 may be used as well.

The cold water tank 20 may be in fluid communication with a cold water dispensing line 32 under the influence of a pump 34. The cold water dispensing line 32 may connect to a directional fitting 36, which will be described in more detail below. During a dispensing operation, water from the cold water tank 20 is drawn into the cold water dispensing line 32 by the pump 34, and may proceed from the directional fitting 36 toward a cold dispensing valve 38, which may be a solenoid valve or other type of electrically-actuated valve. When open, the cold dispensing valve 38 allows the water to be dispensed at the spigot 12. The example in FIG. 1 shows a single spigot 12, and in embodiments of the water-dispensing device 10 that additionally include a hot water tank, the cold water dispensing line 32 and a hot water dispensing line (not shown) can lead to a common dispensing wye (not shown) to allow both hot and cold water to be dispensed by the single spigot 12. However, in some embodiments, separate spigots may be provided for dispensing cold and hot water.

The directional fitting 36 may also connect to a recirculation line 40 that leads back to the cold water tank 20. For example, the recirculation line 40 may couple to a recirculation fitting 42 atop the cold water tank 20 such that water in the dispensing line 32, under the influence of the pump 34, may be redirected by the directional fitting 36 to the cold water tank 20.

Figure 4:
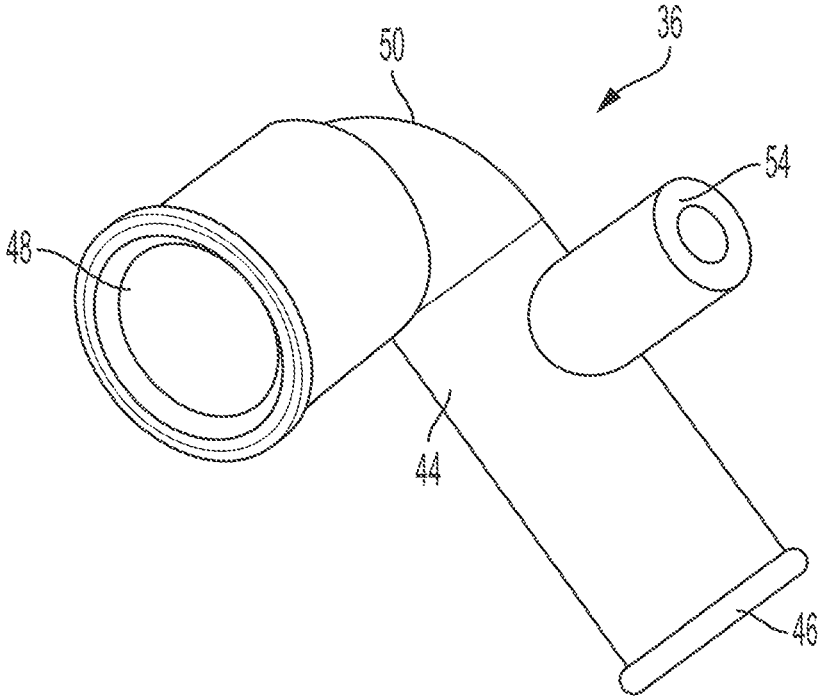
FIG. 4 is a front perspective view of a fitting for use in the water-dispensing device of FIG. 1.

An example of the directional fitting 36 is shown in FIG. 4. The directional fitting 36 may have a hollow main body 44 that extends between an inlet port 46 and an opposing dispensing port 48. The main body 44 of the directional fitting 36 shown in FIG. 4 has an elbow bend 50 formed therein, but other shapes of the main body 44 may be used as well, which can depend on the relative locations of various components of the water-dispensing device 10, spatial considerations within the body 11 of the water-dispensing device 10, and the like. The inlet port 46 is configured to couple to the cold water dispensing line 32 for fluid communication therewith, while the dispensing port 48 is configured to couple to an outlet line 52 (FIG. 3) leading to the cold dispensing valve 38 for fluid communication therewith. A diameter of an opening in the main body 44 at the inlet port 46 may be substantially equal to a diameter of a corresponding opening in the main body 44 at the dispensing port 48.

The directional fitting 36 may further include a recirculation port 54 that intersects with an interior of the hollow main body 44. In the example shown in FIG. 4, the recirculation port 54 extends generally perpendicularly away from the main body 44, although other angles are also contemplated within the scope of the invention. The recirculation port 54 may also be offset on the main body 44 relative to a location of the dispensing port 48 and extend generally perpendicularly or at some other substantial angle with respect to an orientation of the dispensing port 48. The recirculation port 54 is configured to couple to the recirculation line 40 for fluid communication therewith. A diameter of an opening of the recirculation port 54 may also be substantially reduced as compared with diameters of the openings at the inlet and dispensing ports 46, 48.

An air gap 60 may be created between a level 62 of the water in the cold water tank 20 and a top of the cold water tank 20 (see FIG. 3). By connecting the recirculation fitting 42 to a top of the cold water tank 20, the water-dispensing device 10 can take advantage of the air gap and the location, orientation, and smaller diameter of the recirculation port 54 relative to the other ports 46, 48 of the directional fitting 36 to minimize any flow of water through the recirculation line 40 during a dispensing operation to the spigot. That is, when the cold dispensing valve 38 is open and the pump 34 is operational, little to no water will pass through the recirculation port 54 of the directional fitting 36. Instead, the water will pass to the cold dispensing valve 38 and the spigot 12. However, when the cold dispensing valve 38 is closed and the pump 34 is operational, the water will enter the recirculation line 40 via the recirculation port 54 of the directional fitting 36. This arrangement simplifies recirculation of water in the cold water dispensing line 32 because no valves or other actuable components beyond the conventional cold dispensing valve 38 are required to achieve the recirculation operation.

Referring again to FIG. 1, various operations and processes of the water-dispensing device 10, for example, operation of the pump 34 to dispense water and/or recirculate water in the cold water dispensing line 32, manipulation of the fill valve 26, and/or the like, may be performed by at least one controller 70, which may be a microcontroller unit (MCU), a central processing unit (CPU), a microprocessor, an application specific controller (ASIC), a programmable logic array (PLA), combinations thereof, or the like. The controller 70 may include or be coupled to a memory (not shown) that may store code or software for carrying out processes described herein and/or carrying out other operations of the water-dispensing device 10 and may store any captured data for later transfer to remote or external devices. It should be further appreciated that although controller 70 is referred to in this example as a single component, the controller 70 may include a plurality of individual devices, with control functions divided among the individual devices. The controller 70 may be wired or wirelessly connected to components of the water-dispensing device 10 necessary for carrying out the operations and processes described herein.

In some embodiments, the water-dispensing device 10, and particularly the controller 70, may be configured for wired communication (e.g., via USB, Ethernet, IEEE 1394, or the like) or wireless communication (e.g., via WI-FI, BLUETOOTH, ZIGBEE, Z-WAVE, 3G, 4G, or 5G cellular, infrared, or the like) with an external device (not shown), such as a smartphone, laptop, tablet, desktop, or the like. A user may be able to access features and operations of the water-dispensing device 10 through a web browser, a software application installed on the external device, or the like.

Figure 5:
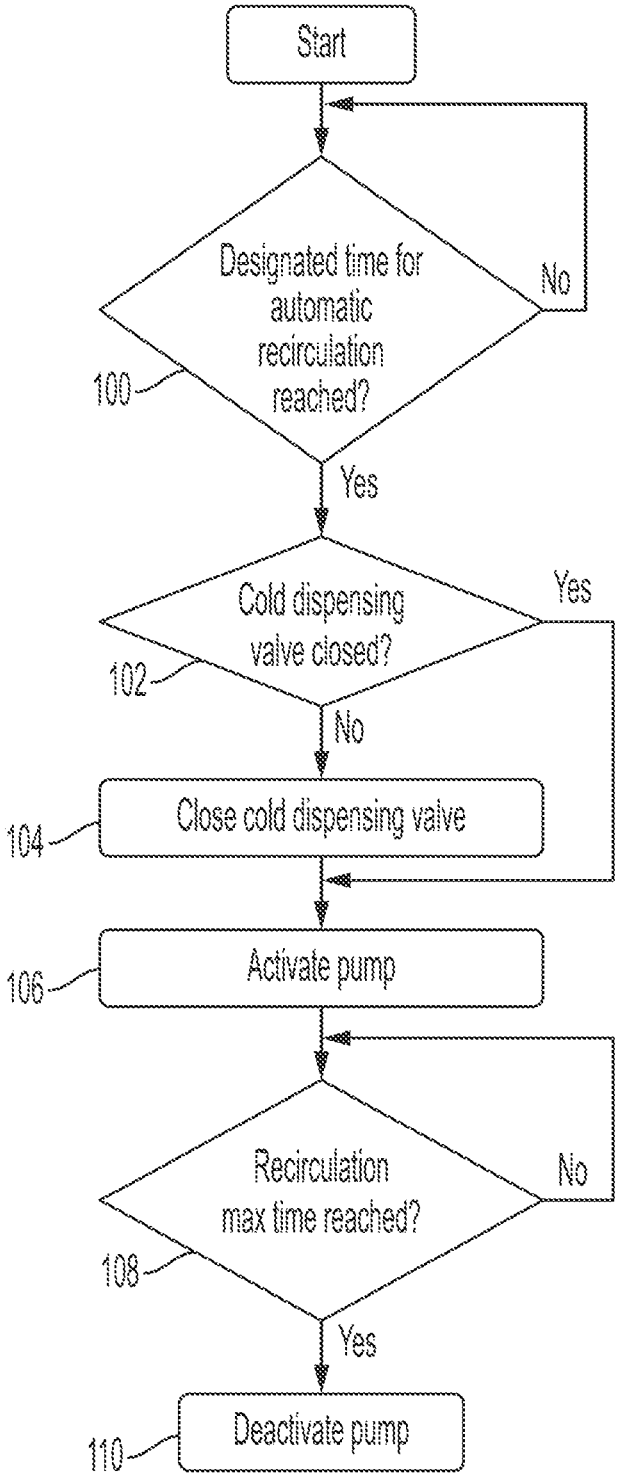
FIG. 5 is a flow chart illustrating an example method performed by a controller for recirculating water in the water-dispensing device of FIG. 1.

FIG. 5 shows an example of a method that may be performed by the controller 70 for automatically recirculating water in the cold water dispensing line 32 back to the cold water tank 20. At step 100, the controller 70 may determine whether a designated time for automatic recirculation has been reached. For example, the controller 70 may be programmed to initiate recirculation if some preset period of inactivity, e.g., fifteen minutes, has elapsed since cold water was last dispensed by the spigot 12. While fifteen minutes is used here as an optimal example based on recirculation testing, other time periods may be used as well, such as ten minutes, thirty minutes, an hour, or some other time period. In some other embodiments, the preset period may be selected or adjusted by a user or operator of the water-dispensing device 10. In more sophisticated embodiments, a temperature sensor may directly or indirectly determine that water in the cold water dispensing line 32 has reached a temperature requiring recirculation (e.g., above 50° F., or the like).

In some other embodiments, the controller 70 may wait for a dispense request before initiating a recirculation operation. For example, when a user requests dispensing via the operation panel 14, the controller 70 may, before dispensing water, opt to clear the cold water dispensing line 32 first to ensure that the dispensed water is cold. This may be done for each dispense request, periodic dispense requests, or upon a dispense request following a preset period of inactivity.

In some embodiments, once it is determined that an automatic recirculation operation should be performed, at step 102, the controller 70 may check to make sure that the cold dispensing valve 38 is closed. This step may prevent leakage from the spigot 12, if for some reason the cold dispensing valve 38 is still open following a dispensing operation or some other fault has occurred. If the cold dispensing valve 38 is not closed, the controller 70 may, at step 104, close the cold dispensing valve 38 before proceeding. If there is a problem closing the cold dispensing valve 38, the controller 70 may report an error condition and cease further operation.

At step 106, the controller 70 may activate the pump 34 for moving water from the cold water tank 20 into the cold water dispensing line 32. As a result, water initially present in the cold water dispensing line 32 will be returned to the cold water tank 20 via the directional fitting 36 and the recirculation line 40. At step 108, the controller 70 may determine whether a preset maximum recirculation time has been reached. Circulation for ten seconds will often be a sufficient amount of time to supply a volume of cold water from the cold water tank 20 that displaces the stagnant water initially residing in the cold water dispensing line 32 and the recirculation line 40 back to the cold water tank 20. However, this time may be dependent on diameters and lengths of the various lines and the output of the pump 34, among other potential variables. Therefore, in some embodiments, shorter or longer preset recirculation times may be used. In another example, the maximum recirculation time may be arbitrarily set by a user or operator. In more sophisticated embodiments, a temperature sensor may directly or indirectly determine that water of a sufficiently cold temperature is present in the cold water dispensing line 32.

The controller 70 may continue to monitor recirculation until the maximum recirculation time is reached, at which point, at step 110, the controller 70 may deactivate the pump 34. The water-dispensing device 10 at this time is ready to perform a dispensing operation. In embodiments where the recirculation operation is performed in conjunction with a dispense request, step 110 may be omitted and instead the controller 70 may open the cold dispensing valve 38. Alternatively, step 110 may be performed temporarily to allow the cold dispensing valve 38 to open, at which point the pump 34 may be restarted to perform a dispense operation.

In some embodiments, the user may be able to initiate a recirculation operation on demand, using the operation panel 14 or an externally connected device. In such instances, the controller 70 may run the pump 34 for a predetermined amount of time, as discussed with respect to FIG. 5, or the user may select an amount of time for recirculation, such as by manually entering a time or depressing a button or like actuator, wherein the pump 34 will run so long as the button or actuator is depressed. Other methods for recirculating the water in the cold water dispensing line 32 may be used as well in keeping with the invention.

Those skilled in the art will recognize that the structures and methods similar to those described above can also be utilized for recirculating water in a hot water dispensing line when the water-dispensing device includes a hot water tank, if desired.

Those skilled in the art will recognize that boundaries between the above-described operations are merely illustrative. The multiple operations may be combined into a single operation, a single operation may be distributed in additional operations and operations may be executed at least partially overlapping in time. Further, alternative embodiments may include multiple instances of a particular operation, and the order of operations may be altered in various other embodiments.

While specific and distinct embodiments have been shown in the drawings, various individual elements or combinations of elements from the different embodiments may be combined with one another while in keeping with the spirit and scope of the invention. Thus, an individual feature described herein only with respect to one embodiment should not be construed as being incompatible with other embodiments described herein or otherwise encompassed by the invention.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined herein.

I claim:

1. A water-dispensing device comprising:

a water tank;

a dispensing line in fluid communication with the water tank;

a pump configured to draw water from the water tank into the dispensing line;

an outlet line;

a dispensing valve;

a spigot downstream of the outlet line and in selective fluid communication therewith via the dispensing valve;

a valveless directional fitting that couples the dispensing line to the outlet line for enabling fluid communication therebetween, the fitting having a hollow main body extending between an inlet port and a dispensing port, the dispensing line being connected to the inlet port and the outlet line being connected to the dispensing port, the fitting having a recirculation port that intersects an interior of the hollow main body, the recirculation port having a diameter that is smaller than a diameter of the dispensing port; and a recirculation line connected at one end to the recirculation port of the fitting and at an opposing end to the water tank to place the water tank in fluid communication with the recirculation port.

2. The device of claim 1, further comprising a controller in wired or wireless communication with the pump.

3. The device of claim 2, wherein the controller is configured to perform a recirculation operation by, with the dispensing valve in a closed position, activating the pump.

4. The device of claim 3, wherein the controller is configured to perform the recirculation operation upon determining that a designated time for automatic recirculation has been reached.

5. The device of claim 4, wherein the designated time is a preset period of inactivity of the pump.

6. The device of claim 2, wherein the controller is configured to deactivate the pump after a maximum recirculation time has been reached.

7. The device of claim 6, wherein the maximum recirculation time is based on a predetermined time required to displace stagnant water residing in the dispensing line and the recirculation line.

8. The device of claim 1, wherein the recirculation line connects to a top of the water tank.

9. The device of claim 8, wherein an air gap is maintained between the top of the water tank and a level of water in the water tank.

10. The device of claim 1, wherein the main body of the fitting has an elbow bend between the inlet port and the dispensing port.

11. The device of claim 1, wherein a diameter of inlet port is substantially equal to the diameter of the dispensing port.

12. The device of claim 1, wherein the recirculation port extends generally perpendicularly away from the hollow main body of the fitting.

13. The device of claim 1, wherein a location of the recirculation port is offset on the hollow main body of the fitting relative to a location of the dispensing port.

14. A method for performing an automatic recirculation operation in a water dispenser having a water tank, a controller, a dispensing line, a pump, an outlet line, a dispensing valve, a spigot downstream of the outlet line and in selective fluid communication therewith via the dispensing valve, a recirculation line, and a valveless directional fitting that couples the dispensing line to the outlet line for enabling fluid communication therebetween, the fitting having a hollow main body extending between an inlet port and a dispensing port, the dispensing line being connected to the inlet port and the outlet line being connected to the dispensing port, the fitting having a recirculation port that intersects an interior of the hollow main body, the recirculation port having a diameter that is smaller than a diameter of the dispensing port, the recirculation line being connected between the recirculation port and the water tank to place the water tank in fluid communication with the recirculation port, the method comprising:

determining, by the controller, whether a designated time for automatic recirculation has been reached;

when the designated time has been reached, checking, by the controller, whether the dispensing valve is in a closed position; and with the dispensing valve in the closed position, activating, by the controller, the pump to circulate water from the water tank into the dispensing line, through the hollow main body of the fitting into the recirculation port, through the recirculation line, and back into the water tank.

15. The method of claim 14, further comprising:

determining, by the controller, if a maximum recirculation time has been reached; and when the maximum recirculation time has been reached, deactivating, by the controller, the pump.

16. The method of claim 15, wherein the maximum recirculation time is based on a predetermined time required to displace stagnant water residing in the dispensing line and the recirculation line.

17. The method of claim 14, further comprising:

when the dispensing valve is found by the controller to be in an open position, closing, by the controller, the dispensing valve.

18. The method of claim 14, wherein the designated time is a preset period of inactivity of the pump.

* * * * *